United States Patent [19]

Kerivan

[11] 4,275,785

[45] Jun. 30, 1981

[54] HEAT EXCHANGE TUBING BLADE ASSEMBLY

[75] Inventor: Leo J. Kerivan, Wellesley, Mass.

[73] Assignee: Industrial Blast Coil Corporation, South Easton, Mass.

[21] Appl. No.: 77,185

[22] Filed: Sep. 20, 1979

Related U.S. Application Data

[63] Continuation of Ser. No. 781,925, Mar. 28, 1977, abandoned.

[51] Int. Cl.[3] ..... F28F 1/14

[52] U.S. Cl. ..... 165/183; 29/157.3 A

[58] Field of Search ..... 165/177, 181-184, 165/150; 29/157.3 A, 157.3 AH, 157.3 B

[56] References Cited

U.S. PATENT DOCUMENTS

| | | | |
|---|---|---|---|
| 851,978 | 4/1907 | Bigsby et al. | 165/183 |
| 2,286,271 | 6/1942 | Higham | 165/15 UX |
| 2,363,224 | 11/1944 | Bronander | 29/157.3 A |
| 2,400,737 | 5/1946 | Brown, Jr. | 29/157.3 A |
| 3,145,456 | 8/1964 | Johnson | 165/183 X |
| 3,360,040 | 12/1967 | Kritzer | 165/181 |
| 3,368,615 | 2/1968 | Brown et al. | 165/184 |
| 3,537,516 | 11/1970 | Kunz | 165/181 |
| 3,886,639 | 6/1975 | Pasternak | 165/181 X |

FOREIGN PATENT DOCUMENTS

| | | | |
|---|---|---|---|
| 1200681 | 7/1970 | United Kingdom | 165/183 |

*Primary Examiner*—Samuel Scott
*Assistant Examiner*—Theophil W. Streule, Jr.
*Attorney, Agent, or Firm*—Parmelee, Johnson, Bollinger & Bramblett

[57] ABSTRACT

An improved heat exchange tubing and blade assembly is described. The heat exchange assembly comprises an elongated tube and an elongated heat exchange blade strip positioned thereon. The heat exchange strip includes an array of integrally formed blade segments which extend from a U-shaped support segment of the strip. Surfaces of the blades extend at a favorable angle of attack to the incident fluid flow stream, and in a preferred embodiment the chords of the blades extend in a direction substantially normal to a longitudinal axis of the tube. The strip is supported on an outer surface of the tube, and a means integrally formed with the tube maintain the support segment in thermal contact with the tube. In a presently preferred embodiment, the tube has a generally streamlined oval cross section for utilization in heat exchanger apparatus such as in an air conditioner, refrigerator or heat pump, with the tubing arranged such that the minor axis of the oval extends perpendicular to the external fluid flow and its major axis extends parallel therewith for reducing the frictional drag and reducing stagnant regions of the external fluid flow. The multiple blades fan out from opposite sides of the oval tubing along its two gently curving arcuate faces where the fluid flow is relatively unimpeded. Moreover, the individual blades in a preferred embodiment are tapered so as to decrease in thickness from root to tip, thereby reducing the mass and weight of thermally conductive material in the blade strips while providing suitable thermal conduction and mechanical strength in the individual blades.

26 Claims, 30 Drawing Figures

158
164
168
166
166
168
162
167
167
9
194
198
196
202
206
166
200
167
204
166
168
167
64
9

194
195
166
202'
191
168
193
167
197
196

HEAT EXCHANGE TUBING BLADE ASSEMBLY

RELATED APPLICATIONS

The present application is a continuation of parent application Ser. No. 781,925, filed Mar. 28, 1977, and was copending therewith. A divisional application of said parent was filed Apr. 27, 1978 under Ser. No. 900,520, and was copending with said parent application. Said parent was later abandoned, and said divisional application issued as U.S. Pat. No. 4,222,160.

BACKGROUND OF THE INVENTION

This invention relates to an improved heat exchange tubing and blade assembly.

Various forms of heat exchange apparatus such as heating and air conditioning apparatus, include a heat exchange tube assembly through which is conveyed a heating or cooling medium. An exchange of thermal energy occurs between this medium and a second medium flowing over the tubing. Heat exchange with the second medium is enhanced by providing a plurality of heat exchange blades which are maintained in thermal contact with the tubing. The blades have a surface area substantially greater than their thickness and increase the effective heat transfer surface which is exposed to the surrounding atmosphere. One such arrangement is described in U.S. Pat. No. 3,457,756, wherein the tube includes integral flat flange segments and the blades are integrally formed with the tube from the flange segments. In another arrangement, the blades are integrally formed in a strip of material which is then continuously helically wound on the tube and secured thereto by an adhesive which is positioned between the strip and the tube.

These prior techniques for increasing the effective heat transfer surface exhibit several disadvantages. When the blades are integrally formed with the tubulation, the number of blades which can be provided to increase the heat transfer surface is substantially limited since a tubulation can provide only a limited number of flat flanges before the cost and assembly procedures become uneconomical and cumbersome. When the blades are formed in a strip which is wound about the tubulation, it has been found that the adhesive used for bonding limits the thermal-conductivity between the blades and the tubulation. In some cases, additional metal, with concomitant additional weight and cost, may be used in the tubing or in the bladed strip or in both to compensate for the thermal insulation effect of the non-metallic bonding layer between the tubing and bladed strip. In addition, fabrication of the heat exchange assembly by helically winding the strip on the tubing is relatively slow and reduces the production capability while increasing the overall cost of the heat exchange tubing assembly.

Furthermore, with the helically wound bladed strip the individual blades become generally uniformly distributed around the full periphery of the circular tubing. When the external fluid medium flows past this bladed tubing in a direction generally perpendicular to the tubing axis, there are fluid flow "dead spaces" which occur immediately ahead of and immediately behind the tubing. The particular blades which happen to project forward ahead of the tubing or backward behind the tubing are resident in these dead space regions where the fluid flow is slow or stagnant. Accordingly, such blades are not very effective in contributing to the overall heat exchange capacity of any apparatus in which such prior art tubing is utilized.

Accordingly, it is an object of this invention to provide an improved heat exchange tube assembly.

Another object of the invention is to provide a heat exchange tube assembly having improved means of mounting a blade strip to the tubulation.

It is a further object of the present invention in accordance with a presently preferred embodiment thereof to provide a streamlined tube assembly which reduces the dead spaces ahead of and behind the tubing and wherein the blades fan out into regions on opposite sides of the tubing where the external fluid flow is relatively unimpeded by the streamlined tubing itself.

SUMMARY OF THE INVENTION

In accordance with the general features of this invention, a heat exchange tubing and multiple heat exchange blade assembly comprises an elongated tube having a longitudinal axis and an elongated heat exchange blade strip positioned thereon. The heat exchange strip includes a longitudinally extending array of integrally formed blade segments which extend from a continuous support segment of the strip stock. This continuous support segment, in a preferred embodiment, is centrally located in the strip stock and is bent into a generally U shape, as seen in cross section. The strip is supported on an outer surface of the tube and extends in the direction of a longitudinal axis of the tube. A means integrally formed with the tube, maintains the support segment on the tube in thermal contact with the surface of the tube. The blades are positioned at a favorable angle of attack to optimize heat transfer versus fan energy ratio, and the blades in one illustrative embodiment are shown positioned for orienting their surfaces in planes which are generally normal to the longitudinal axis of the tube.

In accordance with more particular features of the invention, the means for maintaining the strip in thermal contact with the tube comprises first and second tube segments which are integrally formed with the tube, which extend longitudinally with the tube and which extend outwardly from the exterior surface of the tube and which are spaced apart for captivating the support segment of the strip therebetween. A plurality of strips are provided which are spaced about the circumference of the tube and extend longitudinally therewith. In a preferred arrangement, the captivating tube segments comprise buttresses at least one of which is deformable to mechanically engage and restrict movement of the strip. The tube preferably has an elliptical shaped cross-sectional configuration wherein a major axis thereof is positioned substantially parallel to a direction of flow of an exterior heat transfer fluid stream.

The blades of a strip are shown arrayed longitudinally in pairs in a same plane normal to the longitudinal axis of the tube or they are alternatively positioned in a staggered array. In addition, the blades of laterally adjacent strips are positioned in alignment or are relatively staggered.

A system for fabricating a multi-bladed heat exchange tube assembly comprises apparatus for performing the steps of shearing strip stock to provide a plurality of blade segments, rotating the sheared blade segments to achieve the desired angle of attack in the final heat exchange tubing assembly, and forming the rotated blade segments to provide a longitudinally extending array of juxtaposed or staggered blades which extend from the support segment of the strip stock, which support segment is shown as generally U-shaped. A tube is formed to provide a plurality of longitudinally extending, integrally formed captivating segments. The blade support segment is applied between the captivating tube segments and at least one of the segments is deformed to mechanically engage the strip and secure it to the tube.

In a presently preferred embodiment, the tube has a generally streamlined oval cross section for utilization in heat exchanger apparatus, such as in an air conditioner, refrigerator, heat pump, oil cooler, automobile radiator, automotive space heater, air heater for dwelling or working space, with the tubing arranged such that the minor axis of the oval extends perpendicular to the external fluid flow and its major axis extends parallel therewith for reducing the frictional drag and turbulence of external fluid flow and with the multiple blades fanning out from opposite sides of the oval along its two gently curving arcuate faces where the fluid flow is relatively unimpeded. Moreover, the individual blades in a preferred embodiment are tapered so as to decrease in thickness from root to tip, thereby reducing the mass and weight of thermally conductive material in the blade strips while providing suitable thermal conduction and mechanical strength in the individual blades.

As used herein, the term "strip" or "strip stock" is intended to include thermally conductive flat wire of uniform thickness or of tapered cross section, and is intended to include thermally conductive strip material of uniform thickness or of tapered cross section.

In accordance with other features of the fabrication system, a plurality of strips are mounted on the tube by advancing the tube with blade strips previously mounted thereon to successive stations at which blade strips are similarly applied to the tube at different circumferential locations. The heat transfer assembly thus formed is shaped into a desired configuration, cut to length, and coupling fittings are mounted thereon.

BRIEF DESCRIPTION OF THE DRAWINGS

These and other objects and features of the invention will become apparent with reference to the following specification and to the drawings wherein.

DETAILED DESCRIPTION

Figure 1:
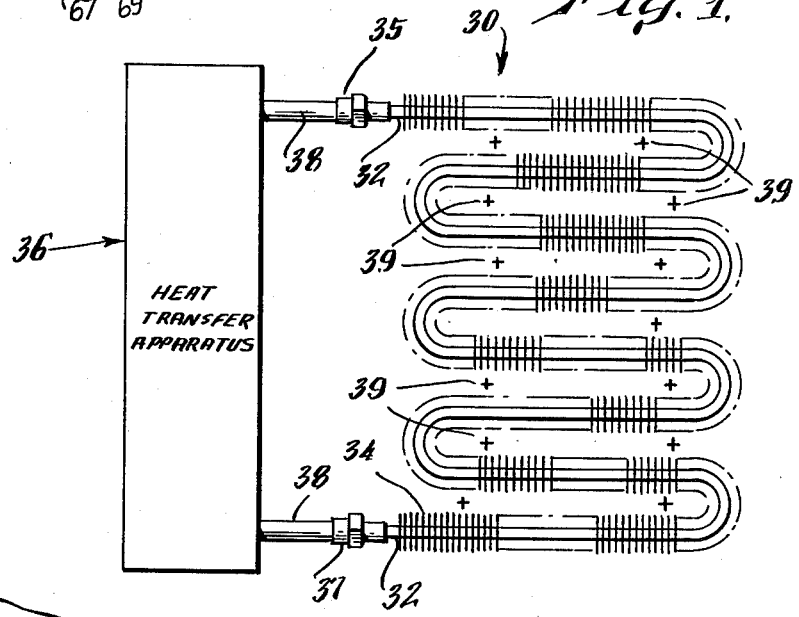
FIG. 1 is a schematic diagram, partly in block form, of a heat transfer apparatus having a heat transfer tube assembly constructed in accordance with features of the invention.

Referring now to the drawings, a heat exchange tube and multiple heat exchange blade assembly constructed in accordance with features of the invention is represented generally in FIG. 1 by reference numeral 30. Assembly 30 comprises an elongated tube 32 and one or more elongated heat exchange strips represented generally as 34. The tube 32 is shown formed into a serpentine configuration such as may be provided with a heat transfer apparatus 36 as for example an air conditioning apparatus. Other various configurations can be provided to satisfy the needs of particular apparatus. A heat transfer fluid medium in liquid or gaseous form flows from the apparatus 36 and through the tube 32. Fluid tight fittings 35 and 37 couple the tube 32 to conduit 38 of the apparatus. Thermal energy is exchanged with a second fluid medium flowing over the assembly and which, for example, comprises air flowing in a direction normal to the length of the tube. In FIG. 1, this flow is into the plane of the paper as represented by the arrow tails 39.

Figure 12:
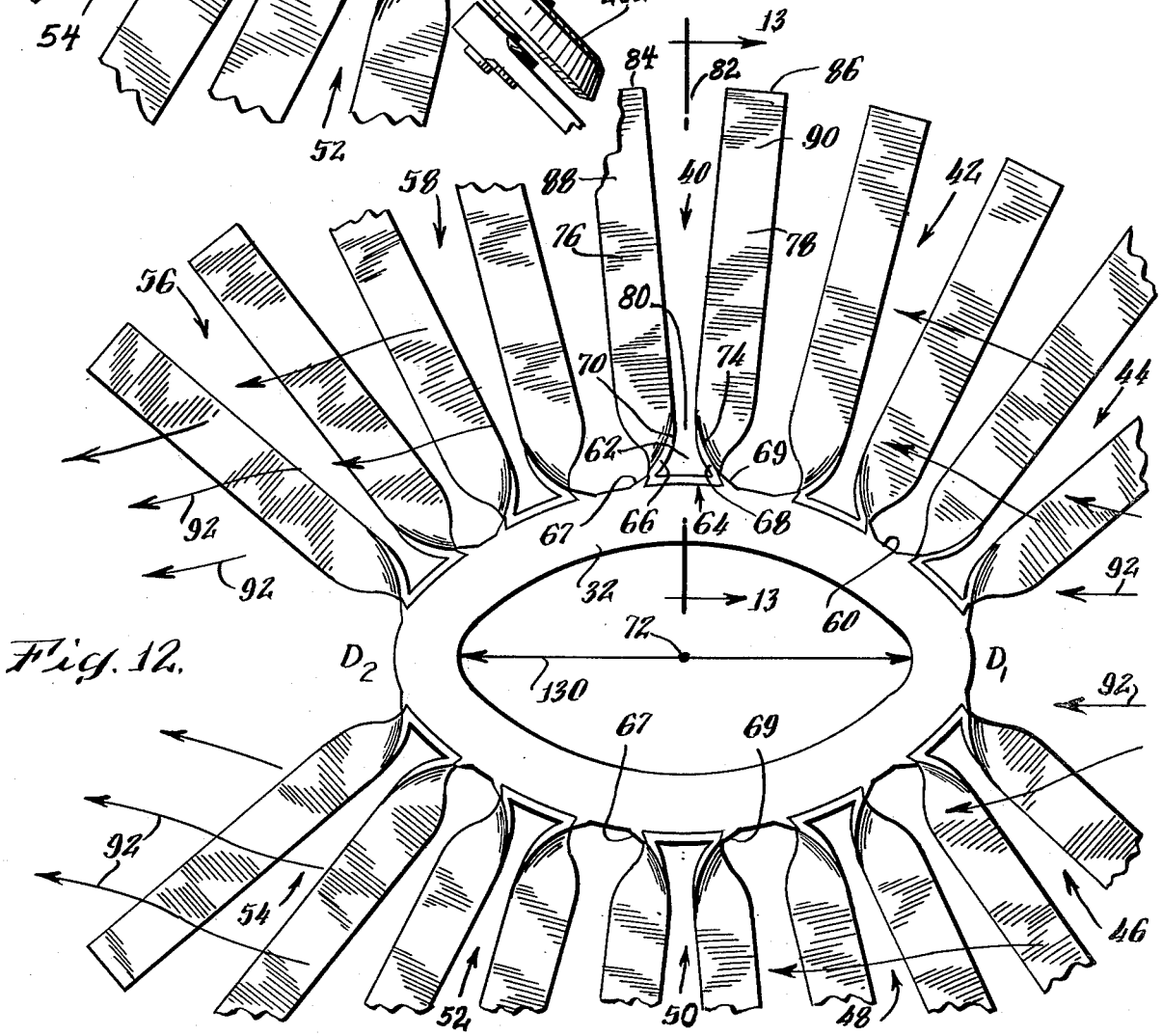
FIG. 12 is an enlarged fragmentary view of a section of a heat exchange tube and multiple heat exchange blade assembly constructed in accordance with features of this invention.

Referring now to FIG. 12, the plurality of elongated heat exchange strips 34 includes strips 40, 42, 44, 46, 48, 50, 52, 54, 56 and 58 spaced circumferentially about an exterior surface 60 of the tube 32 and extending in a direction outwardly therefrom. The elongated strip 40 which is typical of each of the strips is formed of aluminum, copper or other material which exhibits relatively high thermal conductivity. It includes an integral support segment 62 of generally U-shaped configuration having an arc-shaped base segment 64 and outwardly extending, spaced apart leg segments 66 and 68. The base segment is arc-shaped to conform with a surface arc of the tube 32. The U-shaped segment is positioned between longitudinally extending and outwardly extending tube segments 67 and 69 and is captivated in thermal contact with the tube 32 as described in greater detail hereinafter. A surface 70 of the leg segment 66 is shaped to curve in a first angular direction, when viewed from above the strip, from an orientation substantially parallel to a longitudinal axis 72 of the tube 32 to an orientation substantially normal to the axis 72. Similarly, a surface 74 of leg segment 68 curves, but in a second opposite angular direction. The leg segments 66 and 68 extend to integral blade segments 76 and 78 respectively, which fan out in a plane normal to the axis 72 from a relatively narrow spacing at a location 80 of close spacing between the leg segments 66 and 68 to a relatively larger spacing at a location 82 near their distal segments 84 and 86 respectively. Surfaces 88 and 90 of the blade segments 76 and 78 extend in substantially the same plane which is substantially normal to the longitudinal axis 72 of the tube 32 and parallel to the direction of air flow, as indicated by the arrow 92. The strip 40 includes a plurality of blade pairs which extend in a longitudinal array. Blades may be spaced apart longitudinally of the strip by a distance determined by the minimum desired spacing in the direction normal to the fluid flow direction to achieve a reasonable upstream (downstream) pressure drop. This normal spacing may be as small as 0.030 of an inch for air at standard temperature and pressure for a reasonable pressure drop. In this embodiment, as shown assembled in FIG. 12, and as being formed in FIG. 4, there are twenty blades per inch of strip stock and their spacing is 0.050 of an inch longitudinally of the strip 158. This wider spacing produces less pressure drop as compared with a blade spacing of 0.030 of an inch.

In a preferred arrangement, the thickness of the blades tapers. The U-shaped support segment is semi-rigid in that it can be bent during the assembly process in a longitudinal direction yet it is sufficiently stiff to support the blade segments in an upstanding attitude, as is shown. The blades preferably taper in thickness to a relatively more narrow thickness at the distal edges 84 and 86. For example, as shown, there is a tapering in thickness from 0.006 of an inch at the center of the base segment to 0.003 of an inch at the distal edges 84 and 86, which provides a combination of desirable mechanical and heat transfer characteristics for a strip.

Figure 2:
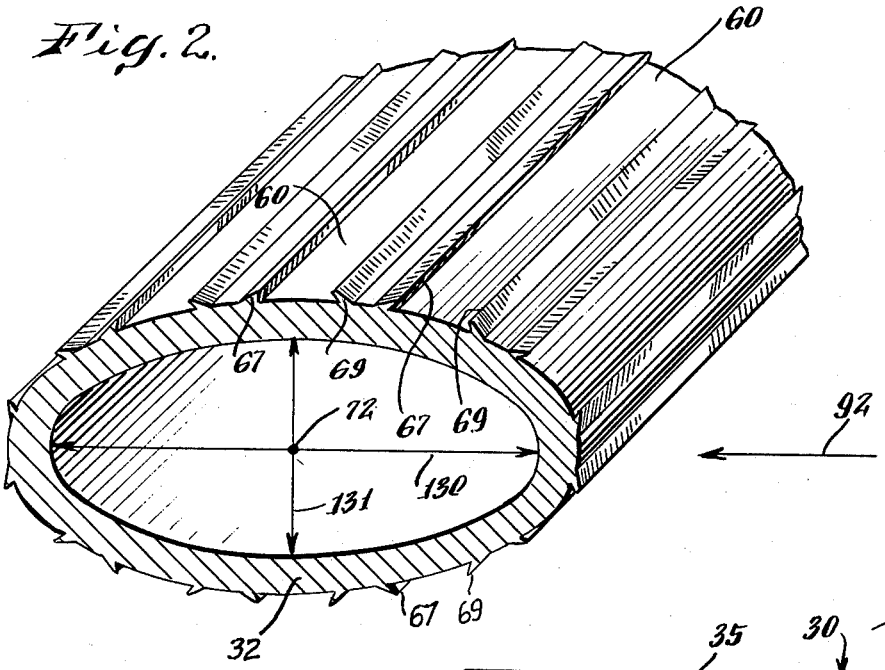
FIG. 2 is a fragmentary sectional view in perspective of a section of a tube of a heat transfer tube assembly constructed in accordance with features of one embodiment of the invention.

As indicated hereinabove, the elongated heat exchange blade strips are supported in thermal contact with the exterior surface of the tubing 32. A heat transfer medium flows through the tube and heat transfer is effected by thermal conductivity between the tube 32 and the strips. The tube 32 is fabricated of a material exhibiting relatively high thermal conductivity as, for example, aluminum or copper. Thermal transfer with the fluid medium is enhanced by reducing friction drag. The tube 32 has a preferred cross-sectional configuration, as illustrated in FIG. 2, which is elliptical and having a major axis 130 parallel to the direction of air flow which is indicated in FIG. 2 by the arrow 92 and with its minor axis 131 perpendicular to this air flow.

By virtue of this elliptical cross section, the tubing assembly, as shown also in FIG. 12, offers a generally streamlined configuration for the airflow 92 passing by. Thus, the turbulence induced in the airflow 92 is minimized so that a vigorous airflow can be provided for effective efficient heat transfer with a minimum amount of fan or blower horsepower required for the heat exchanger. The "dead spaces" $D_1$ and $D_2$ (FIG. 12) immediately in front of and immediately behind the tubing 32 where the air flow tends to be slow or stagnant are minimized in extent. Advantageously, the multiple blades fan out from opposite sides of the elliptical tubing along its two gently curving arcuate faces, as seen in FIG. 12. Therefore, all of these blades project into and are resident in the two regions on opposite sides of the tubing where the airflow is substantially unimpeded by the tubing itself.

Figure 11:
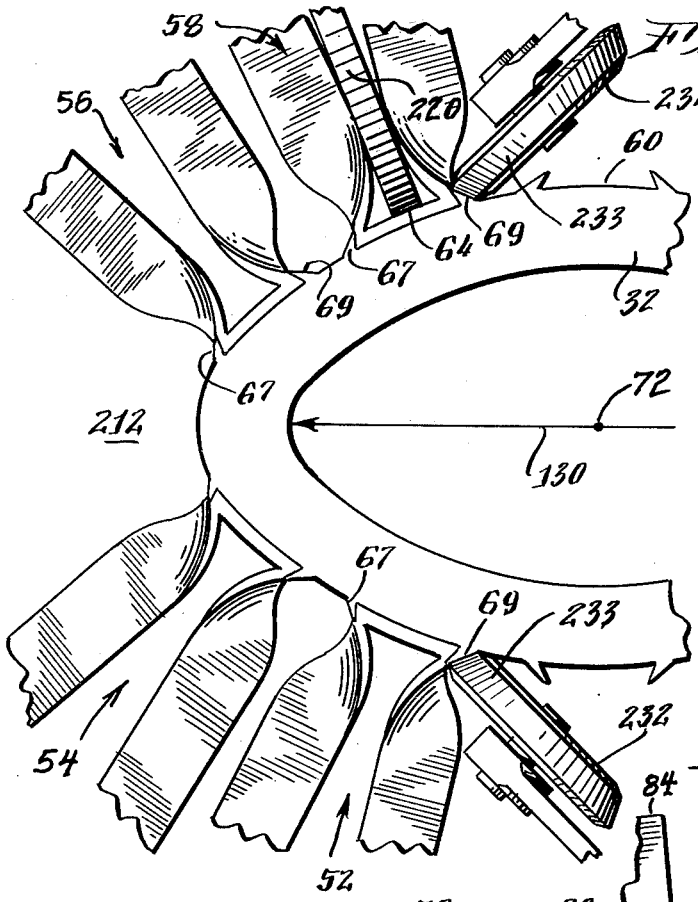
FIG. 11 is an enlarged, fragmentary view of the apparatus utilized for securing a blade strip to a tube.
Figure 13:
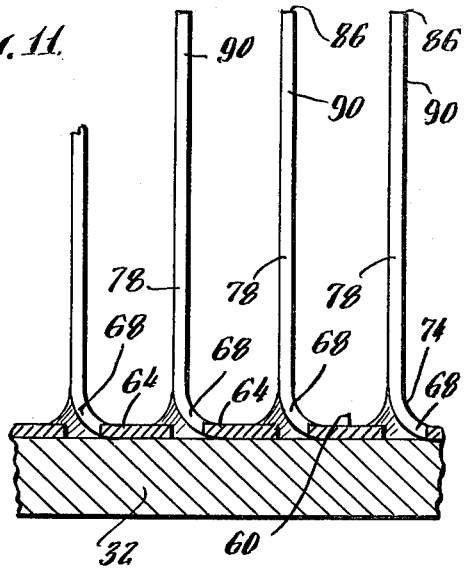
FIG. 13 is a view taken along line 13—13 of FIG. 12.

For maximizing the streamline effect and for maximizing the extent of the two gently curving arcuate surfaces on opposite sides of the tubing 32 from which the multiple blades fan out, it is desirable to form this tubing with a relatively great ellipticity, i.e. to increase the ratio of its major axis to minor axis. However, if the ellipticity becomes too great, then the passage for fluid flow within the tubing 32 becomes unduly restricted. Accordingly, the practicable limit on ellipticity is a ratio of major axis to minor axis of approximately 2 to 1, which is the ratio as shown in FIGS. 2, 11 and 12.

A means is integrally formed with the tubing for maintaining the heat exchange blade strips in thermal contact with the exterior tube surface 60. This means comprises first and second longitudinally extending, integrally formed tube segments 67 and 69 which extend outwardly from the surface and are circumferentially spaced apart for receiving the base segment 64 (FIG. 12) of the U-shaped support segment 62 therebetween and for captivating it. At least one of the segments 67, 64, 69 is mechanically deformed along its length such as by crimping and folds over a portion of the U-shaped base segment for captivating it along its length in thermal contact with the exterior surface 60. A plurality of similar tube segments are spaced circumferentially and extend longitudinally for captivating a plurality of strips. In FIGS. 2 and 12 the tube segments are shown as barb or buttress shaped. Other suitable deformable cross sectional configurations can be utilized. The tube segments are formed simultaneously with the tube during a tube extrusion process or they are alternatively machined in the tube surface after the tube itself has been formed.

Figure 14:
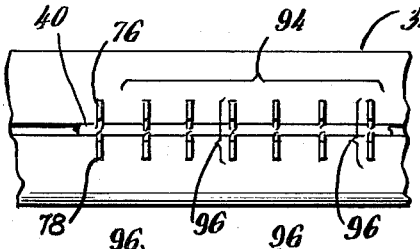
FIG. 14 is a plan view of an array of heat exchange blades constructed in accordance with one embodiment of the invention.
Figure 15:
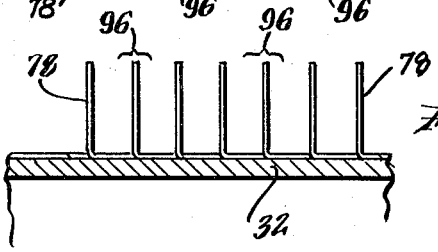
FIG. 15 is a fragmentary view in elevation and partly in section of the blade array of FIG. 14.
Figure 16:
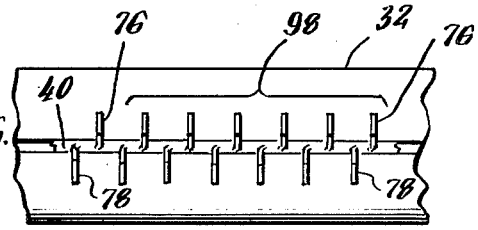
FIG. 16 is a plan view of an array of heat exchange blades constructed in accordance with an alternative embodiment of the invention.
Figure 17:
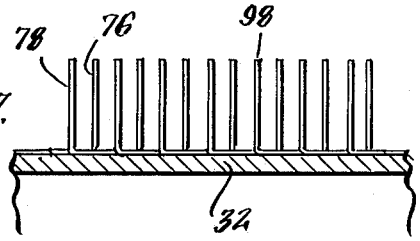
FIG. 17 is a fragmentary view in elevation and partly in section of the blade array of FIG. 16.
Figure 18:
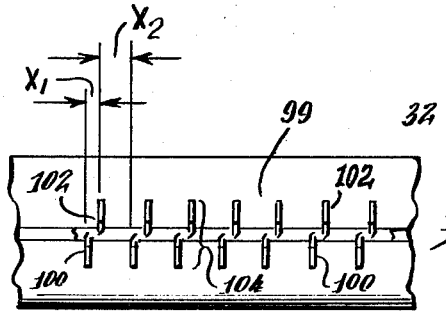
FIG. 18 is a plan view of an array of heat exchange blades constructed in accordance with another alternative embodiment of the invention.
Figure 19:
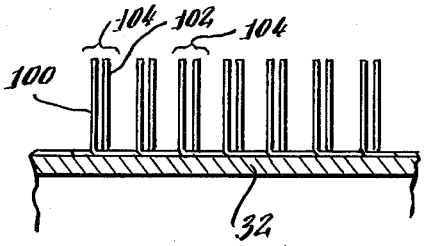
FIG. 19 is a fragmentary view in elevation and partly in section of the blade array of FIG. 18.

As illustrated in FIG. 14, the strip 40 includes a longitudinally extending array 94 of blades wherein the blades are aligned as pairs 96 in a same place. Alternatively, the blades of an array 98 are not aligned as pairs in a same plane but are staggered as shown in FIGS. 16 and 17 so that the blades are substantially equidistant in a longitudinal direction. A further alternative longitudinally offset array is illustrated in FIG. 18 and 19 wherein blades 100 and 102 of a pair 104 are longitudinally offset. However, the blades 100 and 102 are separated by a distance $X_1$ while the blades 102 and 106 are offset by a greater distance $X_2$.

Figure 20:
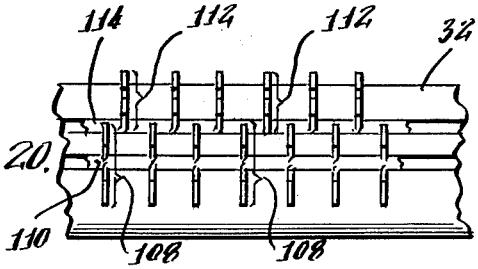
FIG. 20 is a plan view of another array of heat exchange blades constructed in accordance with another alternative embodiment of the invention.
Figure 21:
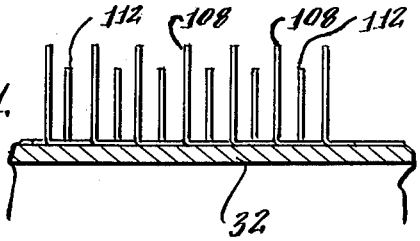
FIG. 21 is a fragmentary view in elevation and partly in section of the blade array of FIG. 20.

In addition to a longitudinal offset of blades in a same array, the blade locations of the different strips are staggered as illustrated in FIGS. 20 and 21. Although blades of pair 108 of strip 110 are aligned in a same plane, the blade pairs 112 of adjacent strip 114 are longitudinally offset from the blades 108.

Figure 22:
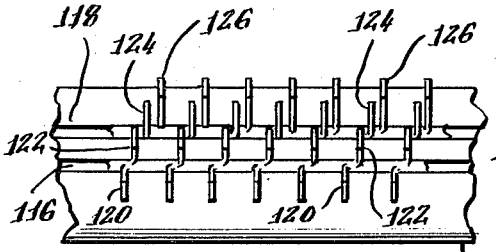
FIG. 22 is a plan view of an array of heat exchange blades constructed in accordance with another alternative embodiment of the invention.
Figure 23:
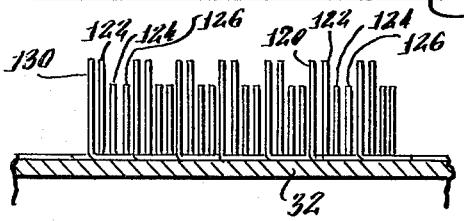
FIG. 23 is a fragmentary view in elevation and partly in section of the blade array of FIG. 22.

Various combinations of blade offsets of the same and adjacent strips can be made to increase fluid medium contact with the surfaces of the blades. In FIGS. 22 and 23, the blade offset of FIG. 18 and strip offset of FIG. 20 are combined. In this arrangement, the blades 120 and 122 of strip 116 are offset. Similarly, the blades 124 and 126 of strip 118 are offset. Strips 116 and 118 have the same blade arrangements, but the strips are longitudinally offset one from the other. Similar strips are utilized and the strips are positioned to provide for offset between lateral adjacent blades of the different strips.

Figure 3:
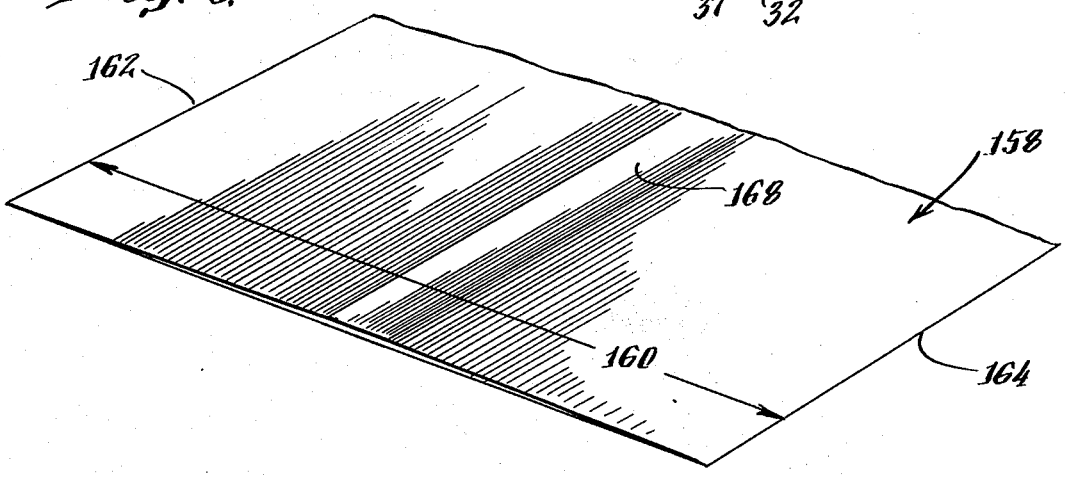
FIG. 3 is a fragmentary perspective view of strip stock from which a heat transfer blade strip of this invention is fabricated.
Figures 4, 9:
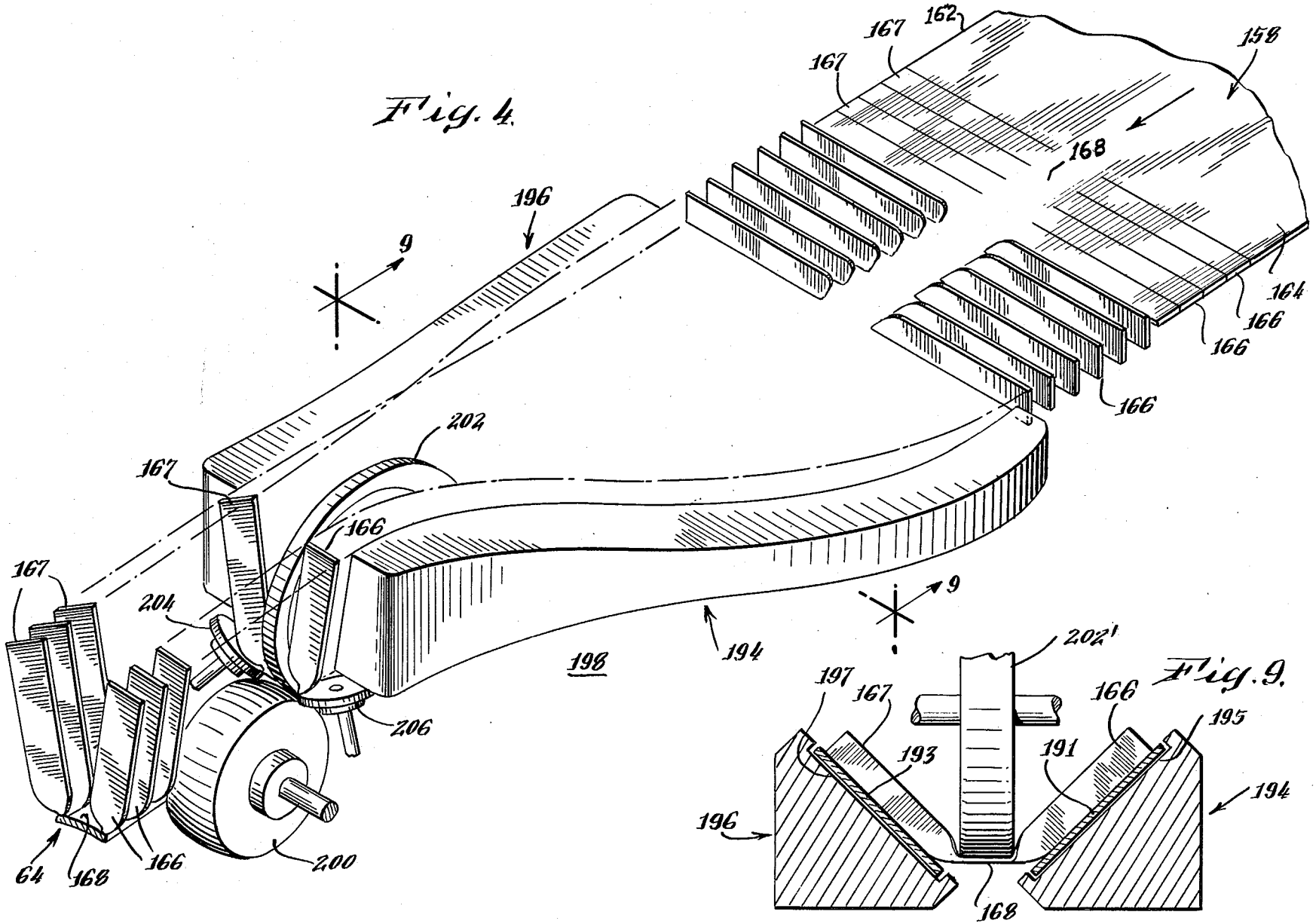
FIG. 4 is a perspective view of an apparatus for forming a heat exchange blade strip in accordance with one embodiment of the invention.
FIG. 9 is a view taken along line 9—9 of FIG. 4.
Figure 5:
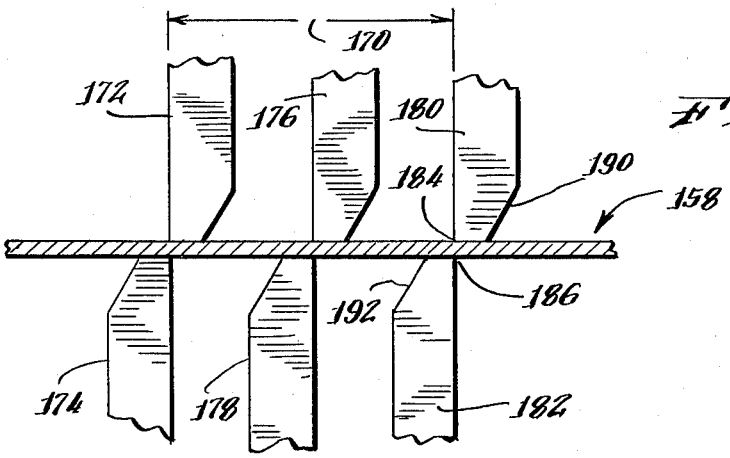
FIGS. 5–8 are views of tooling means employed in shearing and rotating blade segments while forming the heat exchange blade strip of this invention.
Figure 25:
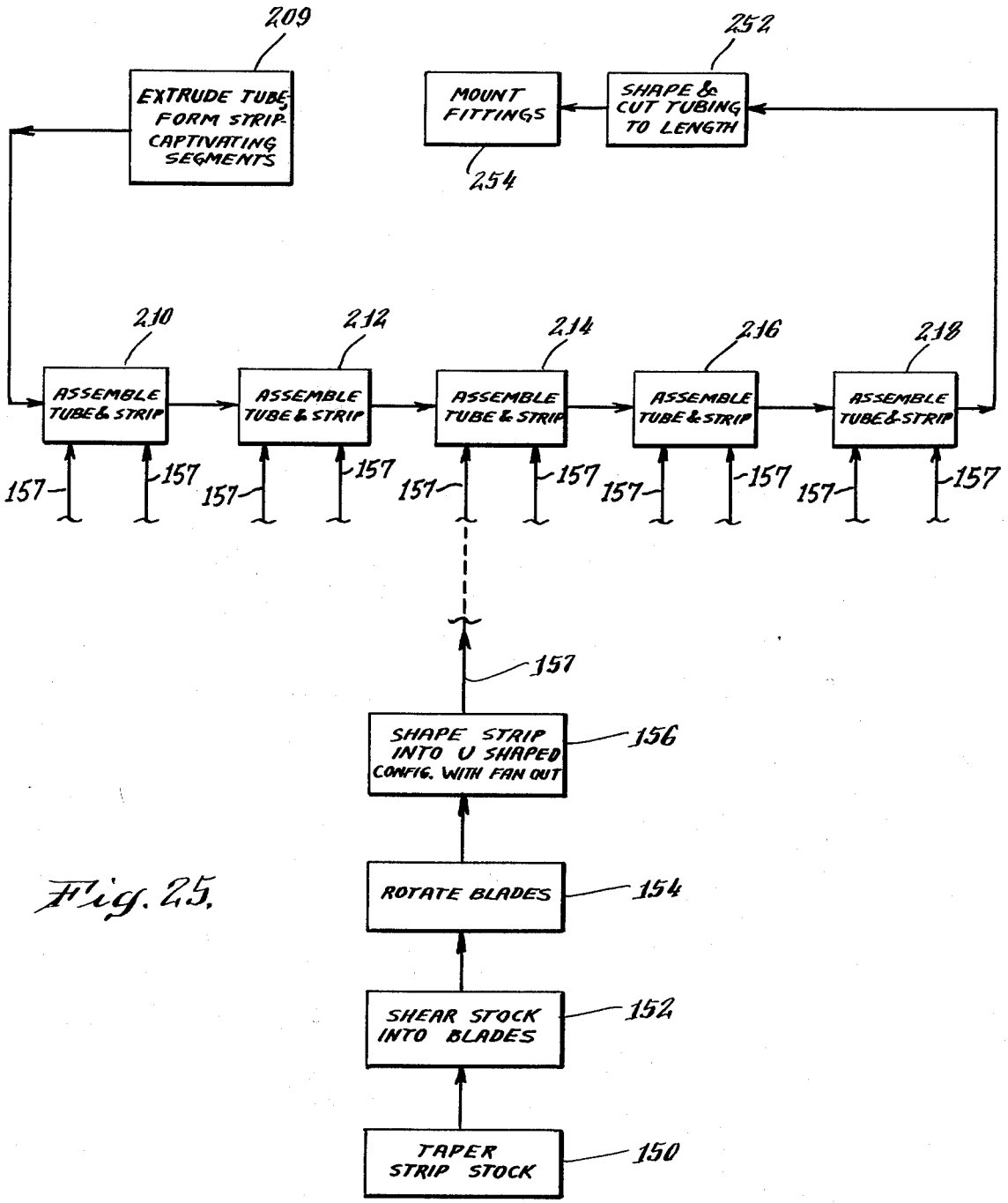
FIG. 25 is a flow diagram in block form illustrating the method for forming a heat exchange tubing and multiple heat exchange blade assembly in accordance with featues of the fabrication system.

A method for fabricating an assembly of elongated tube having elongated heat exchange strips is illustrated in the flow diagram of FIG. 25. As represented by the blocks 150, 152, 154 and 156, tapered strip stock 158 (FIG. 3) is formed having a width 160 substantially equal to the sum of the lengths of the blade segments and the U-shaped segment of a blade. The thickness of the stock tapers from a greater central thickness to relatively smaller dimensions near the elongated edges 162 and 164. The stock is formed of aluminum or copper or other material of relatively high thermal conductivity. In a preferred particular embodiment, the stock tapers from a central thickness of about 0.006 of an inch to a thickness of about 0.003 of an inch near the edges 162 and 164. The tapered strip stock 158 is supplied to a shearing station 152 (FIG. 25) at which location the stock is sheared into relatively narrow blades 166 and 167, as illustrated in FIG. 4. The sheared blades are rotated an angular distance of about ninety degrees about their roots thereby providing that the planes of rotated blades are normal to the plane of a centrally located planar segment 168 (FIG. 4).

Shearing the rotating of the blades 166 and 167 is conveniently accomplished in a single operation, as illustrated in FIGS. 5–8. The stock is advanced with stepwise motion a distance 170, which is a multiple of the blade width, so that a length of the stock is positioned between three sets of cutter bits 172–182. Each of these cutter bits includes a cutting edge as represented by the edges 184 and 186 of the cutter bits 180 and 182, respectively. These tool bits have lengths equal to the length of the sheared blades 166 extending from the flat segment 168 to the distal edges of these blades. A similar set of cutter bits are provided and disposed for shearing and rotating the blades 167. These extend from an opposite edge of the flat segment 168. For purposes of clarity in the drawing, the shear press which is well known is not shown.

Figure 6:
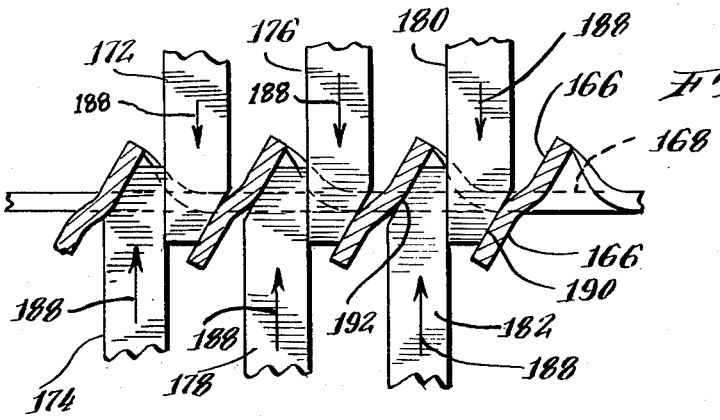
Figure 7:
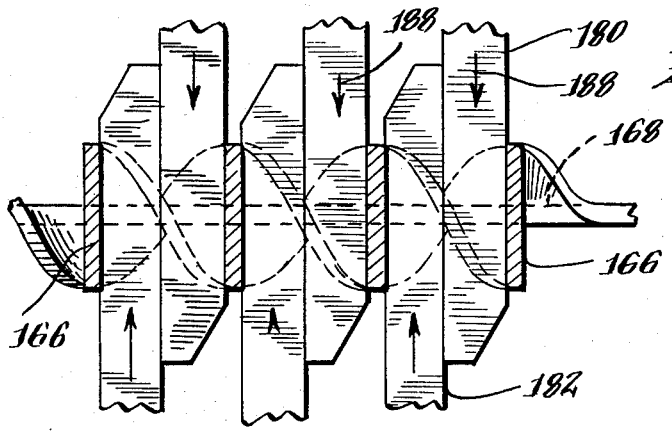
Figure 8:
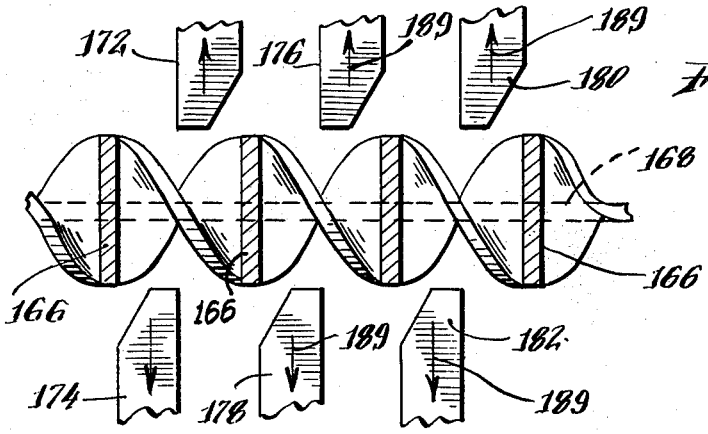

The cutter bits are operated with a reciprocating motion in the direction of the arrows 188 and 189 (FIGS. 5–8) in synchronization with a stepping of a length of stock between the cutter bits. During a shearing and blade rotating stroke, the cutter bits 180 and 182 advance in the direction of arrows 188 and shear the stock to provide juxtaposed blades 166. In addition, the cutter bits overtravel the fully cut position and continue to advance to cause deformation and rotation of the sheared blade segments. This is best illustrated in FIGS. 6 and 7 wherein the bits 180 and 182 continue to travel beyond the fully sheared position. Tapered shoulder segments 190 and 192 engage the surface of the sheared segments forcing them to rotate in a counterclockwise direction, as viewed in FIGS. 5, 6 and 7. The cutter bits continue their rectilinear motion until the sheared blade segments 166 have been rotated an angular distance of about ninety degrees with respect to a plane of the flat segment 168 of the stock. This is illustrated in FIG. 7. After thus having sheared and rotated the blades 166, the bits are withdrawn from the workpiece by reversing the direction of their rectilinear motion as indicated by the arrows 189 of FIG. 8. When the tool bits clear the workpiece, the stock is then advanced a distance 170 to initiate a subsequent shearing cycle. Longitudinally staggered blades, as illustrated in FIGS. 16–19 are fabricated by offsetting the cutter bits in the direction of motion of stock advance which form the respective right and left blades 166 and 167.

Figure 27:
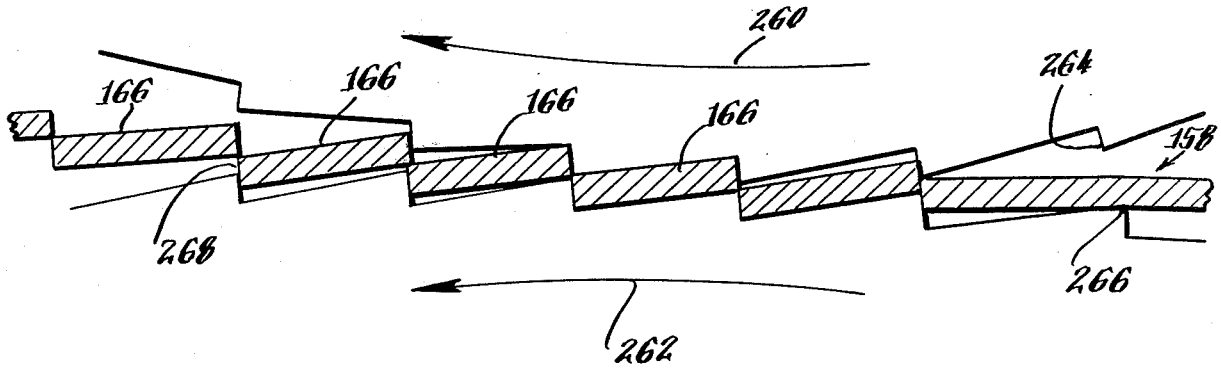
FIG. 27 is a greatly enlarged elevational sectional view illustrating a continuous method and apparatus for rotary shear with blade pre-twist.
Figure 28:
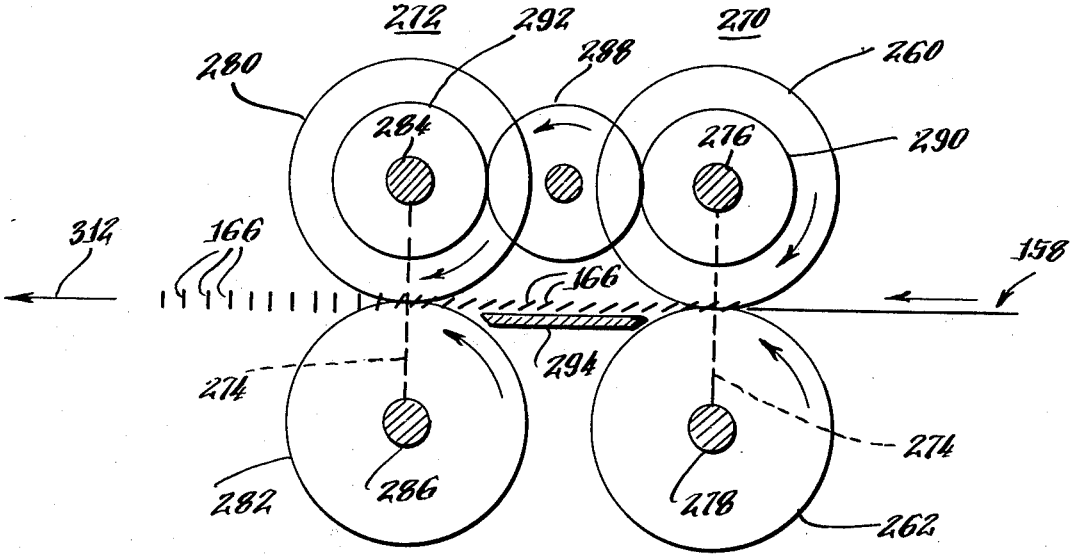
FIG. 28 is an elevational view of a continuous method and apparatus for shearing and pre-twisting the blades followed by final twisting thereof.
Figure 29:
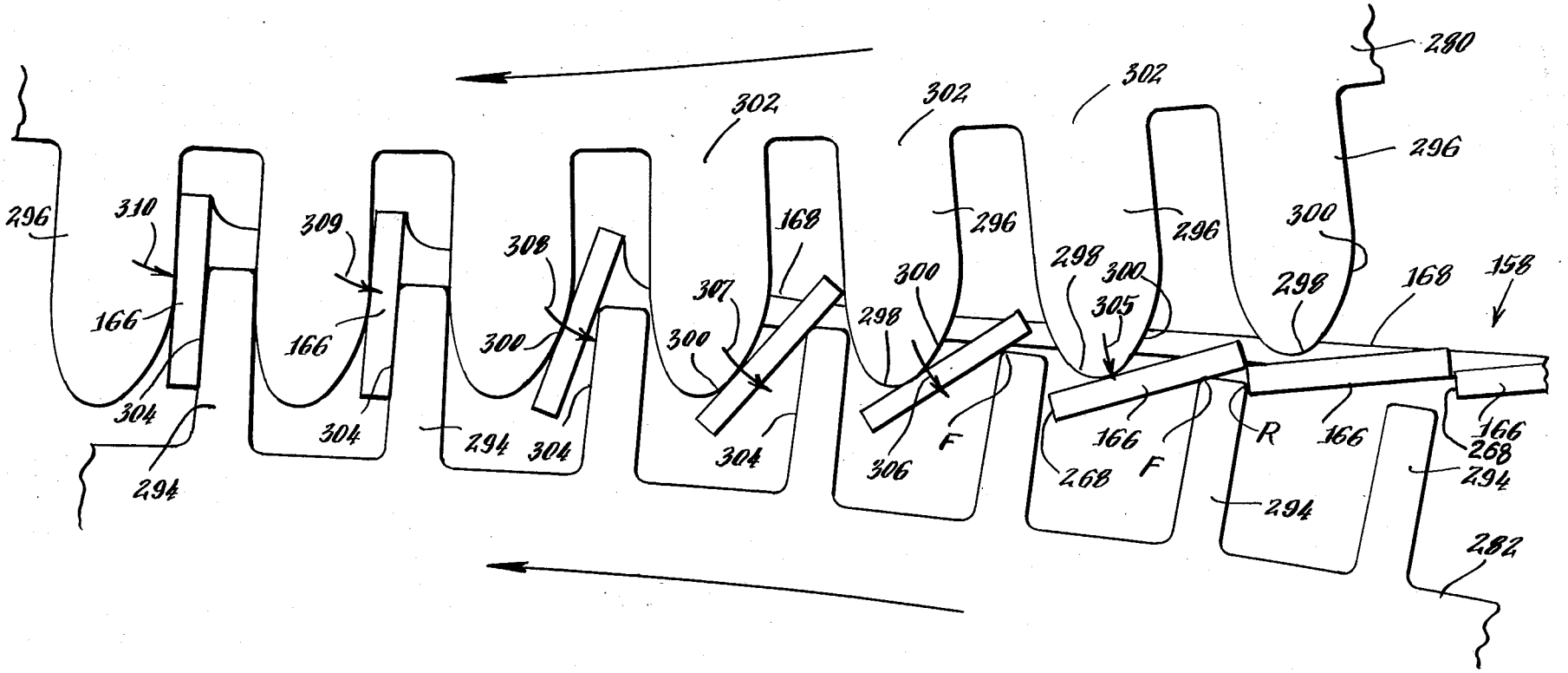
FIG. 29 is a greatly enlarged elevational sectional view of a continuous method and apparatus for final twisting of the blades.

An alternate method for forming and twisting of the blades with continuous strip motion is shown in FIGS. 27–29 which are described further below. When stepwise strip motion is used for fabricating the blades, as shown in FIGS. 5–8, then a slack input loop and a slack output loop are provided in the strip stock preceding and subsequent to the shearing and twisting operation. These slack loops are similar to the slack loops provided in a motion projector for accommodating the local stepwise motion, relative to the continuous motion occurring elsewhere in the whole assembly method.

As indicated in FIG. 4, the sheared and rotated blades are formed into U-shaped segments having a base segment which conforms with the surface of a tube upon which the strip is to be mounted. In FIGS. 4 and 9, the strip having sheared and twisted blades is shown being advanced through a blade fan out positioning operation 198 which includes deformation of the continuous center strip segment 168 during which the sheared and twisted blades are progressively deflected toward each other in a direction normal to the plane of the original strip stock 158 by positioning mechanisms 194 and 196. These blade fan out positioning mechanisms 194 and 196 may include moving skewed surfaces 191 and 193, respectively, of belts moving at approximately the same speed as the twisted blades 166 and 167 for progressively deflecting these blades into their fan out position. Guides 195 and 197 are shown for guiding the respective moving surfaces. A plurality of rolling surfaces arranged in a suitable pattern may be used for performing the forming operation 198. A forming wheel 202' (FIG. 9) engaging the continuous strip segment 168 is shown located upstream from the wheel 202 (FIGS. 4 and 10) for initiating the bending of the U-shaped support segment 64 for the blades.

Figure 10:
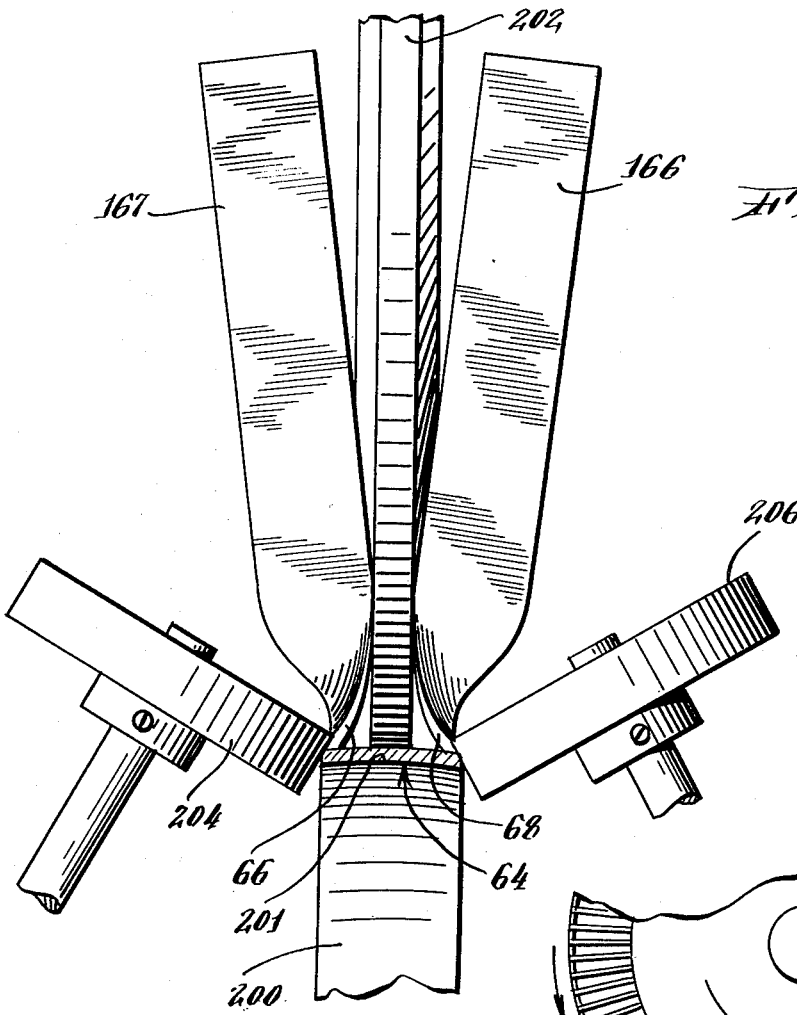
FIG. 10 is an enlarged view of a portion of the apparatus of FIG. 4 for forming and setting the blade strips.

The blade positioning operation 198 is shown using forming wheels 200, 202, 204, and 206. These wheels, as shown in FIGS. 4 and 10, establish forces on the strip being formed which shapes the flat segment 168 of the strip to conform to the shape of the tube 32, forms the U-shaped segment 64 referred to hereinbefore, and sets the blade segments to the desired degree of fan out. The wheel 200 provides a rotating arcuate rest for the strip while the wheel 202 operates to form the base segment to the desired curvature of the tool rest.

The convex transverse rim curvature 201 (FIG. 10) of the wheel 200 is selected to conform to the curvature of a tube surface 60 (FIG. 2) upon which a strip is to be mounted. At the same time that the base segment is being formed, the tool wheels 204 and 206 in cooperation with tool wheel 202 form the integral U-shaped strip segment 64 and set the blades 166 and 167 to the desired degree of blade fan out. This is accomplished by tool wheels which are configured and dimensioned to provide the desired shaping of the base segment and fan out of the blades. These characteristics are selected to satisfy the needs of particular heat exchange tube arrangements. The strip thus formed is supplied to one or more assembly stations 210–218 (FIG. 25). Forming of the bladed strip will progress at a rate adapted for supplying bladed strip material to each of the forming stations 210–218, as shown by the infeed arrows 157 in FIG. 25. Alternatively, separate strip forming means 150, 152, 154 and 156 as thus described are provided to independently supply each of the assembly stations with a bladed strip, as indicated by the respective infeed arrows 157.

In addition to supplying the formed bladed strip to each of the assembly stations, the tube 32 is formed and is supplied in sequence to the stations 210, 212, 214, 216 and 218. The tube is formed by extrusion and the longitudinally and outwardly extending tube segments 67 and 69 for captivating the tube strip are formed simultaneously and integrally with the tube during the extrusion process. In an alternative arrangement, the captivating tube segments 67 and 69 are formed by a machining process after the tube has been formed.

Alternatively, the tube with its multiple pairs of parallel longitudinal protruding attachment segments 67, 69 may initially be made as a strip which is thereafter rolled up and butt welded along its longitudinal edges into a tube.

Figure 24:
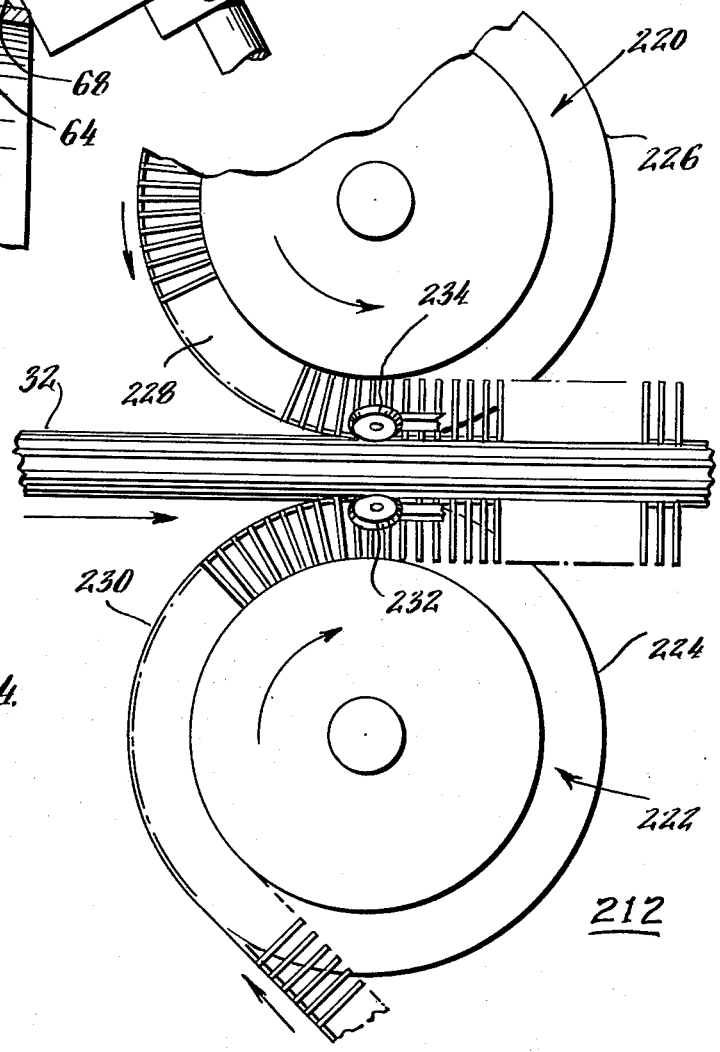
FIG. 24 is a side view of an assembling apparatus for applying an elongated blade strip to a heat exchange tube.
Figure 26:
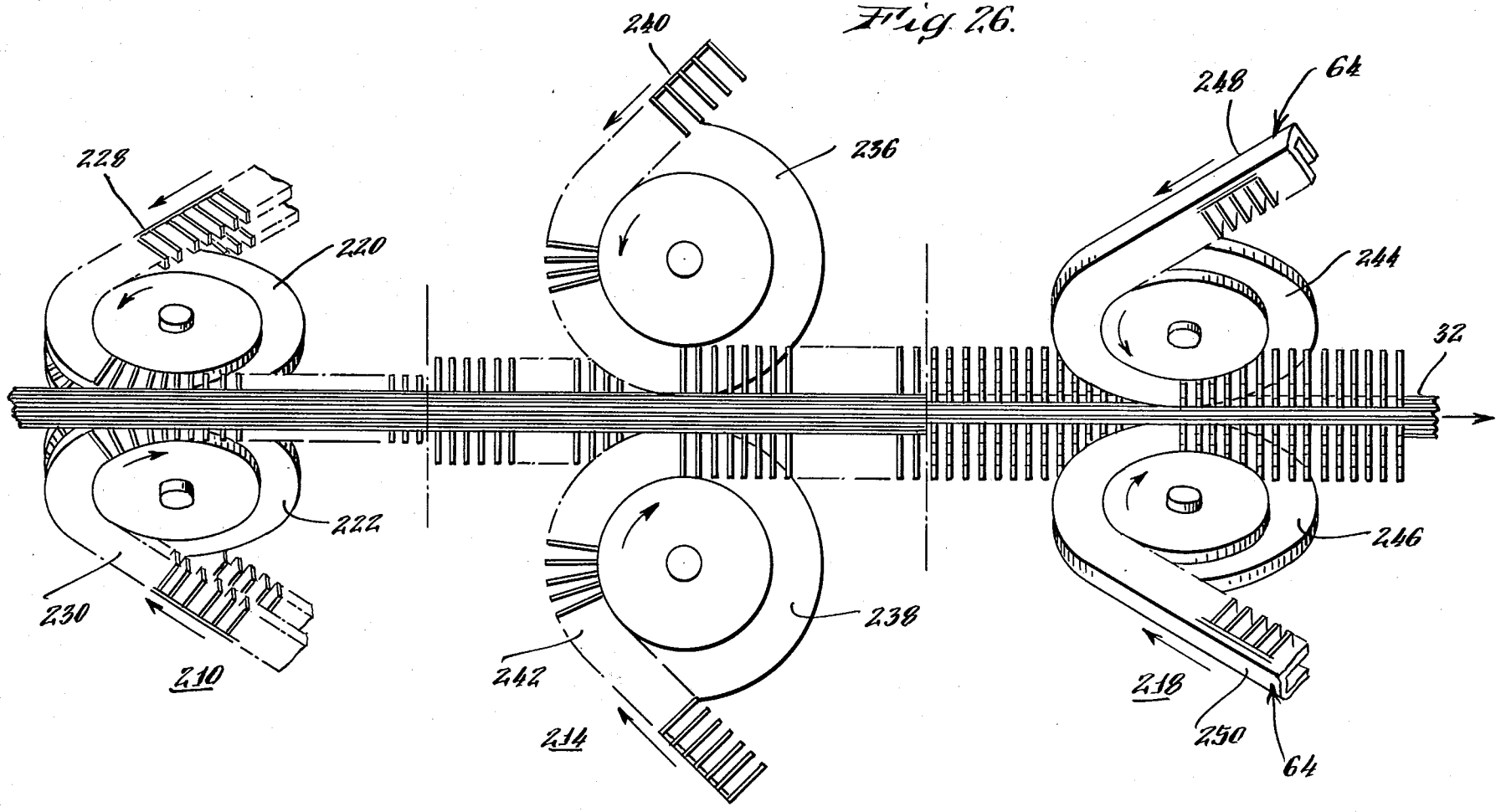
FIG. 26 is a diagram of a plurality of tube and heat exchange strip assembly stations illustrating the application of the heat transfer strips to the tubulation at a number of successively positioned assembly stations.

A tube having a plurality of captivating tube segment pairs 67, 69 is supplied to a first assembly station 210, as illustrated in FIGS. 24, 25 and 26. In FIG. 24, the tube 32 is shown transported between strip supply wheels 220 and 222. The wheels 220 and 222 are symmetrically located with respect to the tube cross section. They are oriented for providing that a periphery 226 of the wheel 220 and a periphery 224 of the wheel 222 supply and position the base segments of strips 230 and 228, respectively, between pairs of captivating tube segments. For example, the arrangement of FIG. 11 illustrates strips 58 and 52 being similarly applied simultaneously. In this manner, the pairs of opposed bladed strips 56 and 54, 58 and 52, 40 and 50, 42 and 48, and the strips 44 and 46 are each simultaneously applied in paired relationship. This symmetrical application of bladed strip pairs in opposed relationship on opposite sides of the elliptical tube major axis 130 reduces the possibility of cross-sectional distortion as a result of the forces exerted on the tube during this bladed strip installation process.

There are also positioned at each of the assembly stations 210–218 crimping wheels such as the crimping wheels 232 and 234 at assembly station 212 and best illustrated in FIG. 11. The spacing between the captivating tube segments 67 and 69 is selected to provide a snug grip on the U-shaped base segment 64 of the blade strip. Wheels 220 and 222 insert the U shaped segments between the segments 67 and 69. The segment 69 is then contacted and deformed by the crimping wheels 232 and 234 as the tube and strip traverse the crimping station. The crimping wheel causes the segment 69 to partly fold over and secure the strip in thermal contact with the exterior surface 60 of the tube 32. The tube 32 with the strips secured thereto is advanced from station 210 to successive stations 212–218 at which locations additional pairs of blade strips are inserted and crimped. Each of these stations applies pairs of strips in symmetrical fashion as indicated hereinbefore to the tube surface 60 at unoccupied locations on the surface between available tube segments 67 and 69. In FIG. 26, the assembly station 214 is shown to include wheels 236 and 238 for applying strips 240 and 242 respectively to the tube 32 while at assembly station 218, the wheels 244 and 246 are shown applying strips 248 and 250 respectively to the tube 32. Offset of the strips as illustrated in FIGS. 20–23 is provided by establishing an offset in the feed of the strips at successive stations.

The assembly of tube and strips is supplied from the station 218 to a shaping station represented by the block 252 in FIG. 25. The assembly of tube and blade strips is shaped into a desired configuration such as the serpentine configuration of FIG. 1. The tube is cut to desired length and coupling fittings as shown in FIG. 1 are mounted to the tube at a station 254.

There has thus been described an improved heat exchange tube assembly and system for fabricating the same wherein a heat exchange blade assembly is supported on and maintained in thermal contact with a heat exchange tube by means integrally formed with the tube. The arrangement is advantageous in that a relatively high density of heat exchange blades are formed on a heat exchange tube and an enhanced thermal conductivity between the blade strip and the tube is thereby provided.

It is to be noted, as seen in FIG. 10, that the tool wheels 200, 202, 204 and 206 form the generally U-shaped base of the bladed strip. The configuration of the arc-shaped base segment 64 plus the two leg segments 66 and 68 has an overall dovetail shape, as seen in cross section. Moveover, in FIGS. 2, 11 and 12, each of the integral projecting segments 67 and 69 of the tubing surface 60, which are spaced apart to define a channel between them, have a generally saw-tooth shape, as seen in cross section. The abrupt surface of each saw tooth faces inwardly toward the channel, while their more gently sloping surface faces away from the channel. Thus, the abrupt faces of the projecting saw-tooth segments or buttresses 67 and 69 are well adapted to captivate the dove-tailed configuration of the U-shaped base of the bladed strip. Also, their more gently sloping outer surfaces are advantageously oriented for crimping inwardly and downwardly onto the dove-tailed configuration of the U-shaped base of the strip. In this crimping operation, as seen in FIG. 11, the corner portions of the dovetail are driven inwardly and downwardly by the inclined crimping wheels 232 and 234 into firm contact with the tubing surface for providing excellent thermal conductivity between the tubing and the blades strips. The inclined crimping wheels 232 and 234 have rims 233 which slope inwardly toward the tubing axis 72 for camming the saw-tooth buttresses 69 inward and downward toward the captivated base segment 64. These crimping wheels 232 and 234 are supported by arms 235 which are positioned at an angle to avoid the blades of the bladed strip being crimped onto the tubing.

The legends in FIG. 25 of the drawings read as follows:

| STEPS | LEGEND |
|---|---|
| 150 | TAPER STRIP STOCK |
| 152 | SHEAR STOCK INTO BLADES |
| 154 | ROTATE BLADES |
| 156 | SHAPE STRIP INTO U SHAPED CONFIGURATION WITH FAN OUT |
| 209 | EXTRUDE TUBE & FORM STRIP-CAPTIVATING SEGMENTS |
| 210 | ASSEMBLE TUBE & STRIP |
| 212 | ASSEMBLE TUBE & STRIP |
| 214 | ASSEMBLE TUBE & STRIP |
| 216 | ASSEMBLE TUBE & STRIP |
| 218 | ASSEMBLE TUBE & STRIP |
| 252 | SHAPE & CUT TUBING TO LENGTH |
| 254 | MOUNT FITTINGS |

With reference to FIG. 10, the transverse rim curvaure 201 of the arcuate wheel rest can be arranged to rovide for toggle insertion of the U-shaped segment 64 etween the captivating tube segments 67 and 69. Thus, he transverse curvature 201 is made considerably more brupt, i.e. of smaller radius, than the mating tube surace. Therefore, the central portion of the base segment 4, as seen in FIG. 11, will initially hump up away from he tube surface. The insertion wheel 220 pushes down n this humped region, to deform it down against the ube surface, providing a toggle action for driving the wo corners of the dovetail blade base into tight fitting ngagement with the captivating tube segments 67 and 9. If desired, this toggle insertion step 220 plus the tube aptivating segment crimping step 234 may both be mployed for securely mechanically locking the bladed trip into good thermally conductive relationship with he tube.

As shown greatly enlarged in section in FIG. 27, the lades 166 (and 167) may be sheared from the strip stock 58 (FIG. 4) by a pair of opposed rotary shear wheels 60 and 262. Each shear wheel has a saw-shaped conour with sharp tooth tips 264 and 266 pressing in shearng relationship against opposite surfaces of the strip tock 158. The blades 166 (and 167) are sheared one rom another and are initially twisted significantly out f the plane of the strip stock 158. This is a first-stage wist. Thus, the leading edge of each pre-twisted blade 66 presents an abrupt leading face 268, which is subsequently used to register each blade for a final twisting peration, as will be explained.

FIG. 28 shows a first station 270 for producing rotary hear and first stage twist of the blades. Downstream is second station 272 for final twist of each blade. The pposed rotary shear wheels 260 and 262 have already een described with reference to FIG. 27. They are ept in registration by a mechanical interconnection 274 etween thin respective shafts 276 and 278. This mehanical interconnection is a pair of mating gears (not hown) mounted on the respective shafts 276 and 278 nd having equal gear pitch circles for keeping the hear wheels 260 and 262 in registration and moving at peripheral speed synchronized with the advancing trip stock 158.

In the final twist station 272, there are a pair of mating lade-twisting wheels 280 and 282 mounted on shafts 84 and 286, respectively. They are kept in registration y a mechanical interconnection 274 which is similar to hat as discussed above.

In order to synchronize the final twist wheels 280 and 82 with the rotary shear wheels 260 and 262, there is an ller gear 288 mating with gears 290 and 292 on the espective shafts 276 and 284. A guide 294 serves to support and guide the strip having pre-twisted blades toward the final twist station 272.

As shown greatly enlarged in FIG. 29, the blade-twisting wheel 282 has relatively narrow teeth 294 which serve as pivot fulcrums about which the individual pre-twisted blades are finally twisted. Moreover, the abrupt leading face 268 of each successive blade 166 bumps against a successive one of the pivot teeth 294, as shown at the registration position "R" for positively registering each pre-twisted blade 166 with a pair of cooperating teeth of the blade-twisting wheels 280 and 282. In summary, the narrow pivot teeth 294 serve to index the pre-twisted blades and also serve as pivot fulcrums about which these blades are twisted into their final orientation.

The other blade-twisting wheel 280 has broader and more rounded teeth 296. The rounded tip 298 of each tooth 296 acts as a rolling cam. This rounded tip 294 produces a rolling camming action, as shown by arrow 305, for pushing the leading edge 268 of the blade down. Each blade is thereby progressively rotated about the pivot fulcrum "F" provided by the rounded leading corner of the cooperating pivot tooth 294.

The teeth 296 also have a more gently rounded trailing surface 300 which slopes inwardly toward the root 302 of the tooth 296. This rounded trailing surface 300 acts as a shallow cam for combing each blade to twist it down parallel with the cooperating combing surface 304 along the leading face of each pivot tooth 294. This twisting combing action is indicated by the successive arrows 306, 307, 308, 309 and 310. Arrows 309 and 310 show the final combing action in which the twisted blade 166 essentially reaches parallelism with the leading combing surface 34 of the pivot tooth 294.

As shown by the arrow 312, the strip with fully twisted blades 166 issues from the continuous motion blade twist station 272 and is fed into the blade fan out positioning operation 198 (FIG. 4).

Figure 30:
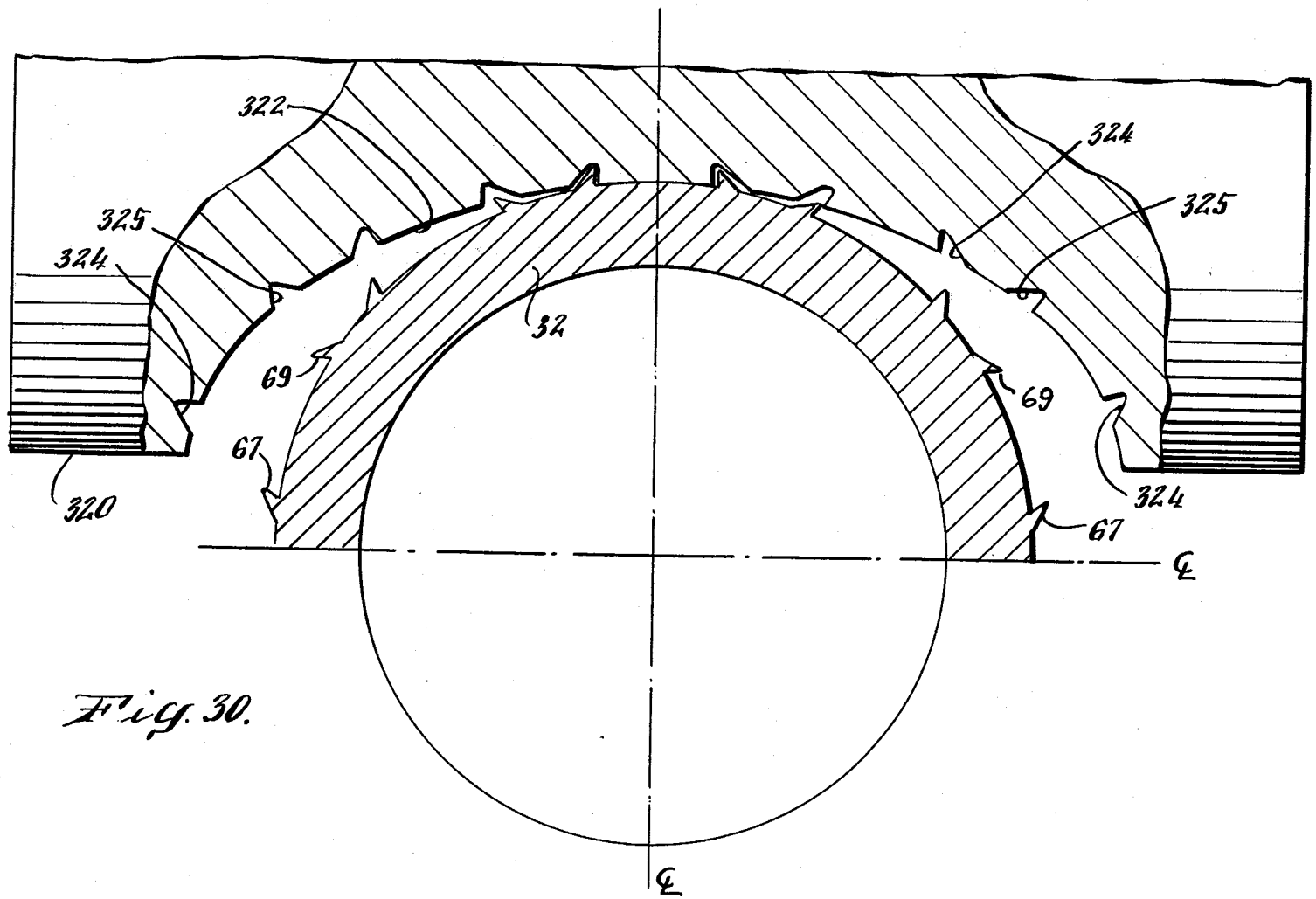
FIG. 30 illustrates method and apparatus for ovalizing the tube with strip captivating segments thereon.

As shown in FIG. 30, the tube 32 with its integral longitudinal segments 67 and 69 may be initially extruded circular. Thereafter, the tube 32 is ovalized by rolling between a pair of rolls 320 (only one is shown) each having a saddle-shaped elliptical rolling face 322, as seen in cross section. There are clearance grooves 324 and 325 in the rolling face of each roll for accommodating the strip-captivating segments 67 and 69, respectively, to prevent crushing thereof. For simplicity of illustration, the lower half of the tube an the other ovalizing roll is omitted from FIG. 30.

It is to be understood that each of the individual blades 166 and 167 may be shaped into a particular configuration which is most appropriate for a specific application. For example, each of these blades may be stamped into a streamlined airfoil configuration or into a rounded pin or finger-like configuration. Thus, the word "blade" is to be interpreted broadly to include protruding heat-exchange elements having such configurations.

Moreover, where the individual blades have an airfoil, rectangular or similar elongated contour with a major chord, as seen in cross section, the blade may be turned slightly relative to the incident fluid stream to produce a small angle of attack for example in the range up to 12° between the direction of the incident fluid stream and the major chord of the blade. Such an angle of attack may be used to produce a more intensive scrubbing of the fluid along the blade surface for augmenting the transfer of heat from the blade into the moving fluid.

Furthermore, it is to be understood that the incident fluid flow may be at an angle of less than 90° to the longitudinal tube axis 72. For example, the incident fluid flow may be at an angle in the range from 30° to 90° relative to the tubing axis 72, and the major chord of the individual blades will be correspondingly oriented. In cases where the blades are pin-shaped or have finger-like contours, they do not have such major chord to be oriented relative to the fluid flow stream.

While I have described a particular embodiment of my invention, it will be understood that variations may be made thereto without departing from the spirit of the invention and the scope of the appended claims.

What is claimed is:

1. A heat exchange tubing and multiple heat exchange blade assembly comprising:

an elongated tube having a passage extending along the axis of the tube for accommodating fluid flow longitudinally within the tube;

said passage within said tube being defined by the inner surface of the wall of the tube, said tube wall having a continuous rounded convex exterior surface as seen in cross section;

said inner surface of said tube wall describing a continuous rounded convex curve as seen in cross section;

said tube having a plurality of pairs of spaced parallel buttresses formed integral with the tube wall and extending longitudinally along the outside of the tube wall parallel with the tube axis and projecting outwardly above the exterior surface of the tube wall;

a plurality of blade strips extending longitudinally of the tube parallel to the tube axis, said strips being circumferentially spaced one from the other;

each of said blade strips having a base segment resting against said exterior surface of the tube and being captivated between a respective pair of said parallel buttresses;

each of said base segments having two rows of blades integrally formed thereon, said two rows being circumferentially spaced from each other relative to the tube with a respective row of the blades being located along each side of the base segment adjacent to the respective captivating abutment buttresses and with said two rows on each base segment extending parallel with each other and longitudinally along the tube;

said blades in the two rows on each base segment projecting outwardly away from the tube;

said blades being twisted near their base segment positioning the surface of each blade generally transverse to the tube for accommodating the passage of exterior fluid flowing generally transversely to the tube;

each base segment of each blade strip being pressed firmly into thermally conductive abutting contact with the exterior surface of the tube wall between its pair of parallel captivating buttresses by at least one of said abutments being crimped laterally toward the base segment and inwardly toward the exterior surface of the tube.

2. A heat exchange tubing and multiple heat exchange blade assembly as claimed in claim 1, in which:

said pairs of spaced parallel abutments are inclined circumferentially one toward the other in each pair as seen in cross section with their inner faces in each pair converging inwardly toward each other above the exterior surface of the tube wall against which the respective captivated base segment is firmly pressed; and the crimped abutments have outer surfaces which are circumferentially inclined as seen in cross section more than their respective inner surfaces for facilitating the lateral and inward crimping of the respective abutment.

3. A heat exchange tubing and multiple heat exchange blade assembly as claimed in claim 1 or 2, in which:

said tube has a streamlined oval configuration as seen in cross section for accommodating said external fluid flowing generally transverse to the tube;

with the inner surface of the tube wall describing a continuous convex curve as seen in cross section;

said tube is positioned with the major axis of said oval configuration extending generally parallel with said external fluid flow for reducing the drag of the transversely flowing external fluid and for minimizing the extent of the relatively stagnant regions of fluid flow in front of and behind said tube;

said oval configuration of said tube provides two gently curving arcuate regions on the exterior surface of the tube wall; and the multiple blades fan out from said two gently curving arcuate regions and each is oriented generally perpendicular to the exterior surface of the tube wall for avoiding said stagnant regions and for projecting into said transversely flowing external fluid where said external fluid flow is relatively umimpeded by the presence of the tube itself.

4. A heat exchange tubing and multiple heat exchange blade assembly as claimed in claim 3, in which:

said streamlined oval configuration is generally elliptical and has a relatively great ellipticity with the ratio of major axis to minor axis not exceeding approximately 2 to 1 for avoiding undue restriction of fluid flow through the passage within the tube.

5. A heat exchange tubing and multiple heat exchange blade assembly as claimed in claim 1, in which:

the thickness of each of said blades tapers to a relatively more narrow thickness at the outer end.

6. A heat exchange tubing and multiple heat exchange blade assembly as claimed in claim 3, in which:

each of said blades is tapered in thickness and has a thickness at its outer end which is approximately one-half of its thickness near its base segment.

7. A heat exchange tubing and multiple heat exchange blade assembly as claimed in claim 1 or 6, in which:

said blades are tapered and have a thickness of approxiately 0.006 of an inch near their base segment and of approximately 0.003 of an inch at their outer ends.

8. A heat exchange tubing and multiple heat exchange blade assembly as claimed in claim 1, 3 or 6, in which:

the respective blades in the two rows along opposite sides of a single base segment are positioned in staggered relationship longitudinally along the tube.

9. A heat exchange tube assembly comprising:

an elongated tube having a passage extending along the axis of the tube for accommodating fluid flow longitudinally within the tube;

said tube having a uniform wall thickness as seen in cross section with pairs of circumferentially spaced ridges projecting outwardly from the exterior surface of the tube wall, said pairs of ridges extending longitudinally along the tube parallel with the tube axis and being integral with the wall of the tube;

said tube wall having said uniform thickness in the regions between the two ridges of each pair, and said tube wall also having said uniform thickness in the regions between the pair of ridges;

a plurality of blade strips extending longitudinally along the tube parallel to the tube axis;

each of said blade strips having a base segment resting directly against said exterior surface of the tube wall and being captivated between a respective pair of said parallel ridges;

each of said base segments having two longitudinal rows of blades integrally attached thereto;

said two rows of blades extending longitudinally along the tube and being spaced apart circumferentially from each other with a respective row of the blades being located along each side of the base segment near to the respective adjacent captivating ridge;

said rows of blades on each base segment projecting outwardly away from the tube such that the base segment of each blade strip together with the two circumferentially spaced rows of blades thereon as seen looking longitudinally of the tube has a generally U-shape;

said multiple blades being twisted near their respective base segments with the surface of each blade extending generally transverse to the tube for accommodating the passage of exterior fluid flowing in a direction generally transversely to the tube;

each base segment of each blade strip being pressed firmly into good thermal conductive contact with the exterior surface of the tube across the full width of the base segment between its pair of parallel captivating ridges by at least one of said ridges being crimped in a circumferential direction toward the base segment and also inwardly toward the exterior surface of the tube.

10. A heat exchange tubing and multiple heat exhange blade assembly as claimed in claim 9, in which ach of said blades in the region thereof near said base upport segment has a predetermined thickness and ach blade tapers to a lesser thickness at its distal end.

11. A heat exchange tubing and multiple heat exhange blade assembly as claimed in claim 10, in which ach of said blades is approximately twice as thick near aid base support segment as it is at its distal end.

12. The heat exchange tube assembly of claim 9, vherein said integral pairs of ridges projecting from the xterior surface of the tube each comprise first and econd elongated buttresses extending longitudinally long the tube parallel with the tube axis and circumferntially spaced for receiving and captivating said base egment between them and wherein each of said butresses has an outer face sloping downwardly in a circumferential direction away from the captivated base egment for streamlining away from the captivated base egment for streamlining the interconnection between he tube and the captivated base segment between them.

13. The heat exchange tube assembly of claim 9, vherein each of said blades in said two longitudinal ows of blades integrally attached to opposite sides of he same base segment is longitudinally spaced apart from an adjacent blade and is staggered in position with respect to the neighboring blades in the other row.

14. The heat exchange tube assembly of claim 13, wherein said staggered blades in the two respective rows along opposite sides of the same base segment are spaced equidistant from each other.

15. A heat exchange tube assembly comprising:

A. an elongated tube having an oval-shaped cross-sectional configuration adapted to have fluid driven by a blower externally past the tube;

B. a plurality of longitudinally extending blade strips each having an array of a plurality of heat transfer blades projecting outwardly from the blade strip;

C. a plurality of pairs of circumferentially spaced parallel buttresses extending longitudinally along the oval tube and being integral with the oval tube and projecting outwardly from said oval tube and each pair mechanically engaging opposite sides of a respective blade strip for pressing said blade strip firmly against the tube in good thermal conductive relationship therewith;

D. said oval-shaped configuration having a major axis and said tubing assembly being adapted to be oriented with respect to the direction of external fluid flow with the length of the tube extending generally transverse to the direction of flow and with said major axis generally parallel with such direction for providing a streamlined configuration for minimizing turbulence induced in the external fluid flow;

E. said oval-shaped cross-sectional configuration of said tube defining an oval-shaped passage extending longitudinally within said tube, and said passage having a continuous convex curved configuration as seen in cross-section; and F. said arrays of heat transfer blades fanning outwardly from the two gently curving arcuate surfaces of said oval tube on opposite sides of said major axis for projecting into the two regions on opposite sides of the tube where such transversely occurring external fluid flow is relatively unimpeded by the tube itself and said blades being spaced apart longitudinally of the tube for permitting such transversely occurring external fluid flow to travel between and among the blades for providing effective efficient heat transfer with a minimum amount of blower horsepower.

16. The heat exchange assembly of claim 15 wherein said oval-shaped cross-sectional configuration is elliptical.

17. The heat exchange tubing assembly of claim 16, in which the ellipticity of said elliptical tube cross-sectional configuration has a ratio of approximately 2 to 1 between its major and minor axes for providing an enhanced streamlined effect for external fluid flow thereby while maintaining adequate fluid flow capacity through the passage within said tube.

18. In a heat exchange tubing assembly, an improved heat exchange blade strip mounted on the exterior surface of a tube with the blade strip extending longitudinally along the tube parallel with the length of the tube comprising:

an elongated blade strip having an elongated U-shaped support segment having a bottom surface which is arched upwardly as seen in cross section for conforming with the exterior surface of a tube on which it is mounted;

a plurality of heat exchange blades integrally formed with and extending from each upstanding leg of said U-shaped support segment;

said blades being positioned in two longitudinally extending arrays located along the respective upstanding legs of said U-shaped support segment;

said blades having major heat transfer surfaces thereof extending in planes substantially normal to the length of said strip; and the upstanding legs of said U-shaped support segment forming acute-angled corners extending along opposite sides of said support segment, said support segment being captivated between longitudinally extending parallel ridges protruding from the exterior surface of a tube on which the blade strip is mounted for pressing said arched bottom surface firmly against the exterior surface of the tube across the full width of said bottom surface.

19. The blade strip of claim 18 wherein each of said blades has a length extending outwardly from said support segment and has a thickness, and the blade thickness decreases along said length toward the outer end of the blade.

20. The blade strip of claim 19 in which the blades in each of said two longitudinal arrays are spaced approximately 0.050 of an inch longitudinally of the strip.

21. The blade strip of claim 19 wherein said blade thickness decreases from about 0.006 of an inch to about 0.003 of an inch.

22. A heat exchange tubing assembly as claimed in claim 16 or 15, in which there are ten parallel rows of blades projecting outwardly from each of said gently curving arcuate surfaces.

23. A streamlined heat exchange tubing assembly comprising:

A. an elongated tube having a passage extending longitudinally therein and having an oval shaped cross-sectional configuration thereby defining a major axis extending in the direction of the greatest width of said oval shaped cross-sectional configuration and a minor axis extending in the direction of the least width of said oval shaped cross-sectional configuration;

B. said tube cross section having two gently curving arcuate convex exterior surfaces on opposite sides of said major axis with two more abruptly curving arcuate convex exterior surfaces at the end of said major axis;

C. a plurality of longitudinally extending bladed strips, each bladed strip having a base segment with a multiplicity of blades extending from the base segment;

D. said base segments extending longitudinally along said tube and being positioned parallel to each other;

E. a plurality of said base segments being positioned directly on each such gently curving arcuate exterior surface and each base segment being circumferentially spaced on the gently curving arcuate surface from the other base segments thereon, and each base segment of a bladed strip being in thermally conductive abutting contact with the gently curving arcuate exterior surface of the tube on which it is positioned;

F. said gently curving arcuate exterior surfaces having externally protruding integral portions thereof mechanically engaging said base segments for holding each base segment abutting against said gently curving arcuate exterior surface of said tube in said thermally conductive contact therewith across the full width of each base segment; and G. said oval shaped tube with said bladed strips as seen in cross section having a plurality of blades projecting outwardly in a diverging fan-out relationship from each of said gently curving arcuate exterior surfaces;

whereby fluid flow directed perpendicular to the length of said tube in a direction generally parallel with said major axis and generally perpendicular to said minor axis flows relatively freely past said streamlined tube with said blades resident in relatively unimpeded fluid flow.

24. A heat exchange tubing and multiple blade assembly comprising:

A. an elongated tube of thermally conductive material having a longitudinal axis and an outer surface thereof;

B. a plurality of bladed strips of thermally conductive metal;

C. each of said bladed strips having a generally dovetail shape base as seen in cross section with two rows of blades;

D. each row of blades extending integrally from a leg segment integrally attached to a respective side of said base;

E. said two rows of blades being on opposite sides of said base and said two rows being spaced apart with the planes of said blades being rotated approximately perpendicular to the length of said strip;

F. the outer surface of said tube having a plurality of spaced elements integral with the tube and spaced apart circumferentially and protruding outwardly beyond the outer surface of the tube for defining a plurality of regions extending longitudinally along the outer surface of the tube, each of said outer surface regions being adapted for receiving the dovetail base of a respective bladed strip thereon; and G. the dovetail base of the respective bladed strip being captivated between the respective spaced elements, said spaced elements being deformed into firm engagement with opposite sides of the U-shaped dovetail base for holding the dovetail base of the bladed strip in firm thermally conductive contact abutting against said regions of the outer surface of the tube across the full width of the dovetail base.

25. A heat exchange tubing and multiple blade assembly as claimed in claim 24, in which said spaced elements extend continuously along the exterior surface of the tube in pairs defining said region of the outer surface of the tube therebetween for receiving the dovetail base of a bladed strip.

26. A heat exchange tubing and multiple blade assembly as claimed in claim 25, in which said dovetail base of said bladed strip has a dovetail exterior configuration as seen in cross section and in which said continuous elements are pairs of saw-tooth shaped buttresses, each having their abrupt surfaces facing inward toward the region of the outer surface between them and having their more gently sloping surfaces facing outwardly away from said region, said abrupt surfaces being deformed into firm captivating relationship with said dovetail configuration for firmly securing the dovetail base of each bladed strip onto the outer surface of the tube.

* * * * *